United States Patent [19]

Pellari

[11] Patent Number: 5,035,030

[45] Date of Patent: Jul. 30, 1991

[54] APPARATUS FOR CONTROLLING AND STRAIGHTENING WEFT AND/OR WARP FABRIC PATTERNS

[76] Inventor: Riccardo Pellari, Via Jacopone da Todi No. 11, 50063 Figline Valdarno, Firenze, Italy

[21] Appl. No.: 502,580

[22] Filed: Mar. 30, 1990

[51] Int. Cl.[5] ..... D06H 3/12

[52] U.S. Cl. ..... 26/51.5

[58] Field of Search ..... 26/51.5, 74, 99

[56] References Cited

U.S. PATENT DOCUMENTS

| | | | |
|---|---|---|---|
| 3,193,688 | 7/1965 | Morton et al. | 26/51.5 |
| 3,633,037 | 1/1972 | Langenbelk | 26/51.5 X |
| 3,721,809 | 3/1973 | Strandberg, Jr. et al. | 26/74 X |
| 3,755,861 | 9/1973 | Gastro et al. | 26/74 |
| 4,068,789 | 1/1978 | Young, Jr. et al. | 26/51.5 X |
| 4,201,132 | 5/1980 | Zimmer et al. | 26/51.5 X |
| 4,255,050 | 3/1981 | Beckstein et al. | 26/51.5 X |
| 4,303,189 | 12/1981 | Wiley | 26/51.5 X |
| 4,305,184 | 12/1981 | Woythal | 26/51.5 |
| 4,890,924 | 2/1990 | Beckstein | 26/51.5 X |

FOREIGN PATENT DOCUMENTS

| | | | |
|---|---|---|---|
| 2035403 | 6/1980 | United Kingdom | 26/51.5 |

OTHER PUBLICATIONS

Automatic Weft Straightening Equipment, A. P. Worthington, A.T.I. The Textile Manufacturer, Jul. 1970, pp. 266–273.

*Primary Examiner*—Werner H. Schroeder
*Assistant Examiner*—John J. Calvert
*Attorney, Agent, or Firm*—McGlew & Tuttle

[57] ABSTRACT

The apparatus comprises in combination: a computerized opto-electronic reader (3), able to control the fabric pattern moving along a linear transverse inspection zone, said reader being capable of detecting data of pattern deviation from a reference pattern; and a set of actuators (9, 10, 11, 12, 13, . . . N−2, N−1, N) with respective servomotors, with encoder or the like, controlled by the signals emitted by said opto-electronic reader (3). The actuators are disposed to act each on a corresponding fabric zone, to locally correct the pattern deviations detected by the opto-electronic reader.

20 Claims, 5 Drawing Sheets

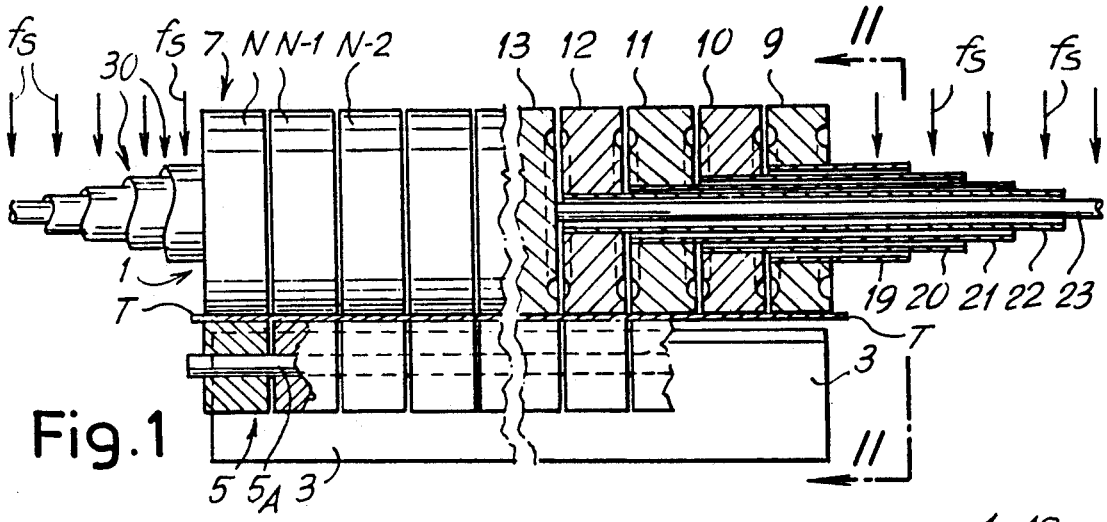
Fig.1
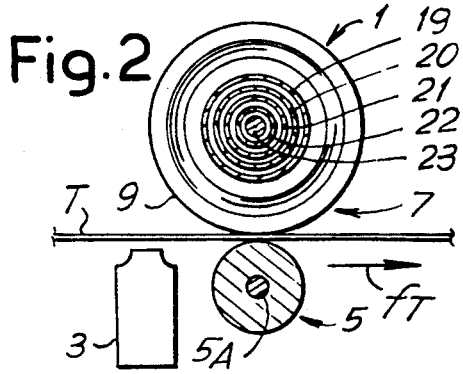
Fig.2
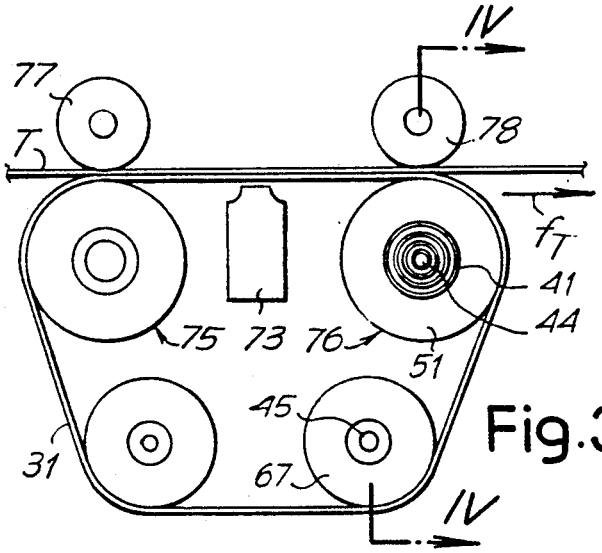
Fig.3
Fig.4
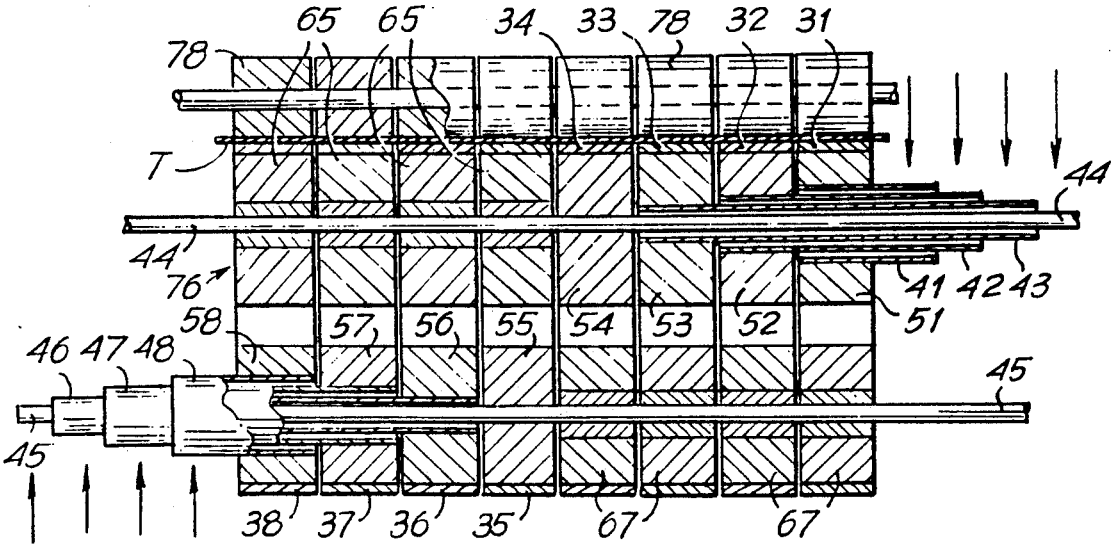

APPARATUS FOR CONTROLLING AND STRAIGHTENING WEFT AND/OR WARP FABRIC PATTERNS

FIELD AND BACKGROUND OF THE INVENTION

The invention relates to detecting and correcting the pattern distortions which occur in fabrics, both in weft and chain. As it is well known, such distortions are detrimental when articles such as clothes, are manufactured from pattern fabrics. These and other objects and advantages will be apparent to those skilled in the art by reading the following description, which discloses different possible applications of an apparatus for straightening fabric patterns.

SUMMARY

The apparatus for the control and straightening of the fabric patterns according to the invention comprises in combination: a computerized opto-electronic reader, able to control the fabric pattern moving in front of a linear transverse inspection zone, said reader being capable of detecting data of deviation of the pattern from a reference pattern; and a set of actuators with respective servomotors, with an encoder or the like, controlled by the signals emitted by said opto-electronic reader. Said actuators are disposed to act each on a corresponding fabric zone to locally correct the pattern deviations detected by the opto-electronic reader.

Each of said actuators may comprise a continuous flexible member in the form of a belt, driven by pulley members or equivalent, at least one of which is driven into rotation by the servomotor in order to act on the fabric. Alternatively, each of the actuators may comprise a member driven into rotation by the servomotor in order to act on the fabric.

In a possible embodiment, the actuators are disposed into alignment along at a least one front transversally located with respect to the longitudinal development of the fabric, in order to have each one of said actuators acting onto a longitudinal zone of the fabric in transit.

In a further possible embodiment, rotating members driven by respective servomotors are distributed on two or more transmission axes. Moreover, more rotating and coaxially disposed members can be actuated by coaxial shafts associated to the respective servomotors.

The reader may be so disposed as to control a linear transverse zone of the fabric close to the transverse zone of the fabric on which the actuators are made to operate.

In a possible embodiment, in which continuous flexible members are used, the latter are transparent, and the reader is disposed therewithin in correspondence of the zone thereof which acts on the fabric.

Especially for a chain or warp straightener, a rotary discoid member may have a plurality of small cylinders or wheels peripherally disposed which contact the fabric. Said cylinders are idly mounted on axes developing tangentially with respect to the periphery of the rotary discoid member in order to reduce the friction on the fabric.

For chain straighteners, the actuators may be disposed into alignment on a front transversally located with respect to the longitudinal development of the fabric, the driving shafts of the actuators being parallel to the chain pattern. These actuators may be disposed on at least two transverse and adjacent alignments, those of one alignment being offset to those of the other. When belt actuators are used, the driving shaft of an actuator may serve as a support for an idle transmission pulley of an adjacent actuator. A reader may be disposed for controlling a linear transverse inspection zone of the fabric which is close to the transverse zone of the fabric on which the actuators operate.

An apparatus according to the invention may be associated to a stenter dryer plant to act on the incoming fabric which must be engaged with its edges onto the conveyer of said plant.

Such an apparatus may be combined to a doubling machine and fabric tenter machine, for coupling the two fabrics to one another, two apparatuses being provided to act on each of the two fabrics, one independently of the other. Advantageously, the two readers are combined with a control unit to achieve a mutual correction of position and a coincidence of weft patterns of the two doubled fabrics, during the transit of the fabric for the doubling. Provision may be made for a lamina which is interposed between the two fabrics. Said lamina forms two counteracting surfaces for the actuators which act on the relevant fabrics by opposite sides of said lamina.

An apparatus according to the invention may also be combined to a sewer for sewing the edges of joined fabrics.

Moreover, an apparatus according to the invention may be associated directly to a fabric rewinder and may comprise means for regulating the advancement speed.

BRIEF DESCRIPTION OF THE DRAWINGS

The invention will be better understood by following the description and the attached drawing, which shows practical non limiting embodiments and applications of the same invention. In the drawing:

FIG. 1 shows a scheme of an apparatus for the control and the straightening of the weft pattern in a cross-section view;

FIG. 2 shows a diagrammatic section on line II—II of FIG. 1;

FIG. 3 shows a modified embodiment in a section similar to that of FIG. 2;

FIG. 4 is a local section on line IV—IV of FIG. 3;

DETAILED DESCRIPTION OF THE PREFERRED EMBODIMENT

Figure 5:
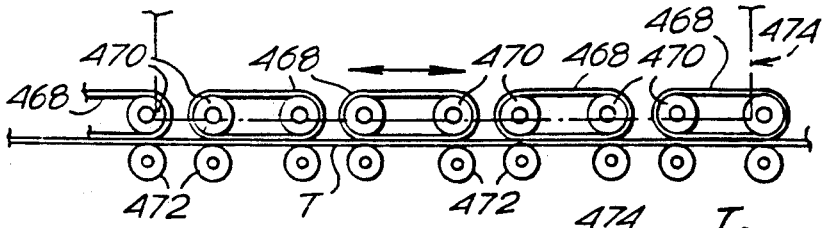
FIGS. 5 and 6 show a diagrammatic cross-section and a view on line VI—VI of FIG. 5 of a chain straightener according to the invention.

In FIGS. 1 and 2, T indicates the fabric which is made to slide in the direction of arrow fT through the apparatus. Numeral 1 generally indicates the weft straightening apparatus according to a first embodiment. This apparatus comprises a computerized opto-electronic reader, generically indicated with 3, which extends transversally to the direction of advancement of fabric T and by a length equal to the fabric width. The fabric T moves through two rows of roller means—that is to say cylinder means. Said cylinder means comprise pressing cylinders 5, and cylinder means 7 which is made up of a plurality of sections, i.e. rotating members 9, 10, 11, 12, 13, . . . N−2, N−1, N, each consisting of a rotating discoid member having a peripheral cylindrical surface, which is made more or less rough or which may be clothed to act tangentially on the fabric T. The various rotating members 9, 10, 11 . . . N−2, N−1, N are coaxial and each of them is driven by its own servomotor so as to consitute a plurality of actuators able to act longitudinally on corresponding zones of the fabric T in the direction indicated by arrow fT, in order to displace each of the fabric zones, acted upon by one of the actuators, with respect to the other zones. For driving each of the above mentioned rotating members, coxial and tubular shafts are provided, as indicated by 19, 20, 21, 22 respectively for the members 9, 10, 11, 12, as well as an inner shaft 23 for the rotating member 13. The same disposition on the opposite side is intended for driving the rotating members N, N−1, N−2, etc., with a corresponding number of tubular shafts and a central shaft generally indicated by 30. The individual servomotors which drive the above mentioned shafts act through suitable transmissions which, in the scheme of FIG. 1, are indicated by arrows fS reaching the individual shafts. The individual rotating members cooperate with the cylinder 5, which is made up of discoid members corresponding to the individual rotating members 9, 10, 11, 12, 13 . . . N−2, N−1, N and which are idly mounted on a support shaft 5A.

The reader 3 is capable of inspecting a linear transverse zone for sensing the trend of the weft pattern, in particular of the weft pattern lines which may not be straight and which must be corrected in relation to a reference line stored within the reader. The purpose of this inspection by the reader 3 is to generate driving signals for the actuators and thus for the respective servomotors, so as to modify the angular, peripheral displacements of the various rotating members 9, 10, 11, 12, 13 . . . N−2, N−1, N, to correct any non-rectilinear pattern line thereby changing the detected trend and make said line straight.

This arrangement is, thus, a weft pattern corrector. Obviously, each of the above mentioned rotating members is capable of imposing different modifications to the respective fabric zone, according to the deformation detected by the computerized optical reader, so as to determine a corresponding negative or positive correction and thus the return of the fabric with transverse weft patterns made substantially straight.

With respect to the fabric T, the reader 3 may be disposed on the side of cylinder means 7 or on the side of cylinder 5, and the fabric will be positioned so as to present the weft pattern as visible as possible in front of the computerized reader 3.

According to FIGS. 1 and 2, all the actuators which act on the various zones in which the width of the fabric is divided for the correction are mounted on a same cylinder means 7 of rotating members 9, 10, 11 . . . N−2, N−1, N. Therefore, the number of shafts arriving at each end of cylinder means 7 must be half the number of the rotating members and thus of the actuators provided in the apparatus.

According to another arrangement, as shown in FIGS. 3 and 4, it is possible to further divide the drivers for the actuators. In this disposition, instead of providing rotating members to act as actuators, there are provided flexible belt members as indicated by 31, 32, 33, 34, 35, 36, 37, 38 in FIG. 4. In practice, of course, the number of the above mentioned belt members will correspond to the number of actuators provided for the correction along the fabric width. The individual belts 31 . . . 38 and others, are moved by pulley members, one of which is driven into rotation while the other(s) is (are) idly mounted. According to the example in the drawing, each belt is driven around three idle pulley members and a driving pulley member which imposes the corrections to the weft pattern through its own servomotor.

In FIG. 4, four actuators 31, 32, 33, 34 are provided which are driven by respective coaxial shafts 41, 42, 43 and 44 through respective encoder and servomotors or the like, with drive transmissions indicated by the arrows, to impose the desired corrections to the respective belt actuators 31, 32, 33, 34. Each shaft 41, 42, 43, 44 ends with its own pulley 51, 52, 53, 54, which is driven and which in turn drives the respective belt 31, 32, 33, 34. The other belts, such as the belts indicated by 35, 36, 37, 38, are moved around pulleys 65 idly mounted on shafts 41, 42, 43, 44. These idle pulleys may all be mounted, e.g. on the central shaft 44 which drives the pulley 54. Belts 35, 36, 37, 38 are driven by driving pulleys 55, 56, 57, 58 disposed on a different transmission axis and driven by respective coaxial shafts 45, 46, 47, 48. The internal shaft 45 idly supports the transmission pulleys 67 for the belts 31, 32, 33, 34. The same arrangement can be provided on each of the axes of the pulleys which move the above mentioned belts. In the illustrated example, wherein for each belt there are provided four pulleys, the pulleys that can be made to act as driving pulleys by coaxial shafts are only in a number equal to a fourth of the total. On each axis of the pulleys the coaxial shafts can extend from only one end or from the two opposite ends of the set of pulleys, as in the arrangement of FIGS. 1 and 2.

The opto-electronic reader in this disposition may be located outside the belt arrangement, but it can also be disposed as indicated at 73 inside the belt arrangement, the latter being in this case transparent to allow the reading of fabric T which moves in the direction of arrow fT or in opposite direction between two groups of coaxial pulleys indicated by 75 and 76 and the relevant counteracting cylinders 77 and 78, the latter being formed by individual cylinder portions corresponding to the individual belts, each portion being idly mounted on a support shaft. The reader may also be disposed between the two groups of rollers 77 and 78. In this arrangement the reader is better centered with respect to the actuators than in the arrangement of FIGS. 1 and 2.

An apparatus for the control and straightening of the weft as above described may be combined to an apparatus—built according to the same criteria—which allows the correction of the chain or warp pattern, for the straightening the lines having longitudinal development in the fabric pattern.

Figure 6:
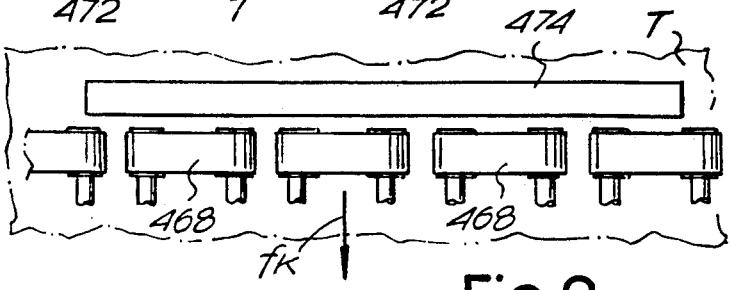

According to what is illustrated in FIGS. 5 and 6, the fabric T is made to advance in the direction of arrow fK between a set of belts 468 driven by pulleys 470 and disposed transversally with respect to the fabric advancement direction, counteracting pulleys 472 or other equivalent means of belt type for example are placed in a position such as to correspond to pulleys 470. The belts 468 are driven by the one of the two respective pulleys 470 which is in turn driven by servomotors with encoder or equivalent means controlled by signals generated by a computerized opto-electronic reader, generically indicated by 474. The opto-electronic reader extends trasversally to the advancing fabric over its whole width and in the vicinity of the front of belts 468. The latter may be all adjacent on a same transverse plane and the axes of the pulleys may be parallel to the fabric feed direction.

The computerized opto-electronic reader 474 detects the chain pattern as this is moved in front of the reader, and the computerized reader unit compares the detected chain pattern with a stored pattern, thus generating signals for controlling the transverse motion of belts 468 relevant to each section in which the fabric front is divided. In this way, the active branches of belts 468 (those shown in the lower part of FIG. 5) operate the correction of the position of the chain pattern by displacing this transversally with respect to the advancement direction indicated by fK. The control signals are selective for each one of the groups 468, 470, thereby a control signal is given at each fabric zone to change the pattern and ensure a substantial rectification of the chain pattern to make it substantially longitudinal. Belts 468 may be provided on the outer surface with suitable means for the adherence to the fabric in order to drag the fabric along and deviating it in the direction of the desired correction while allowing, at the same time, the longitudinal sliding thereof.

The pulleys 470 of each belt may be able to be brought closer to one another to limit the correction zone, and the individual belts will then be drawn as close as possible to one another to ensure a substantial continuity of the front for the correction of the warp, that is, chain pattern.

Figure 7:
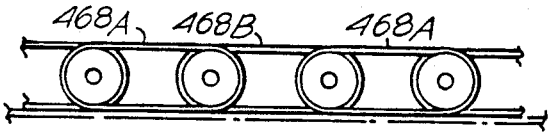
FIGS. 7 and 8 show a modified embodiment with respect to that of FIGS. 5 and 6.
Figure 8:
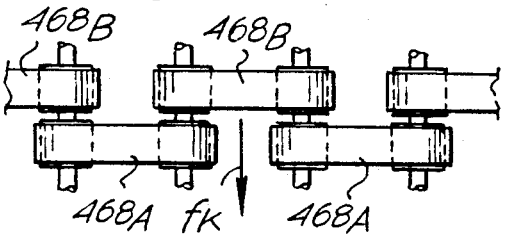

FIGS. 7 and 8 show a modified embodiment in which two transverse, parallel and adjacent fronts of belts 468A and 468B are provided, the belts of one front being offset with respect to those of the other front in the direction of the fabric advancement indicated by fK. The belts 468B are predisposed to determine the control and adaptation of the chain pattern in the portion between the pulleys of adjacent belts 468A. Provision may also be made to drive belts 468A and 468B for advancement around pulleys mounted on the same axes, each axis being the driving axis for one of the pulleys, for example the one for belt 468B, and the idle support axis for the pulley of the corresponding belt 468A, and vice versa for the adjacent axis.

Figure 9:
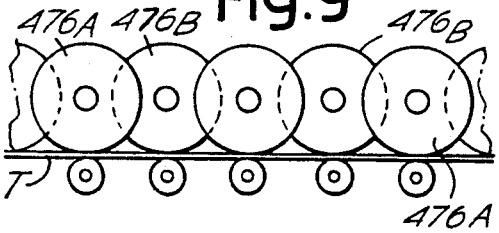
FIGS. 9 and 10 show a further modified embodiment with respect to those of FIGS. 5, 6 and 7, 8.
Figure 10:
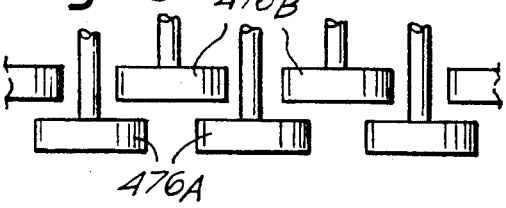

A similar disposition, which may be developed with one transverse work front only, as in the solution of FIGS. 5 and 6, or with two work alignments, as in the solution of FIGS. 7 and 8, is illustrated in FIGS. 9 and 10. In this embodiment, the belts 468 driven by pulleys 470, are replaced by discoid members 476 which can be disposed on a single row, that is to say on a single front where they are brought close to one another, or on two fronts of discoid members 476A, 476B as shown in the drawing, the two alignments being contiguous and the discoid members of each front being offset in an intermediate position with respect to those of the other front to achieve a very frequent intervention over the active front by the warp straightener.

Figure 11:
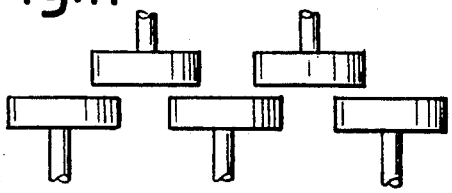
FIGS. 11 and 12 show two further modified embodiments.

FIG. 11 shows, similarly to FIG. 10, a disposition which differs from that of FIG. 10 so as to have the axes of the discoid members of one front extending in a direction opposite to that of the other front, in order to have the discoid members of each front more closely disposed.

Figure 12:
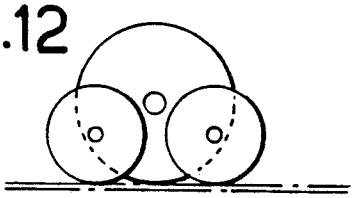

For the same purpose, there may be provided the solution of FIG. 12, which includes discoid members of different diameters for the two fronts.

Figure 13:
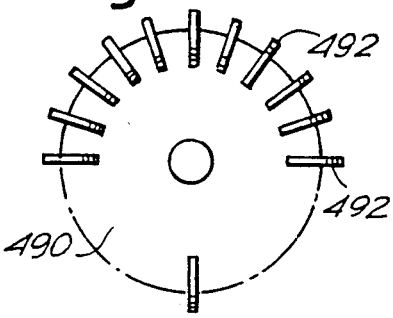
FIGS. 13 and 14 show an improved embodiment of the discs of FIGS. 9, 10.
Figure 14:
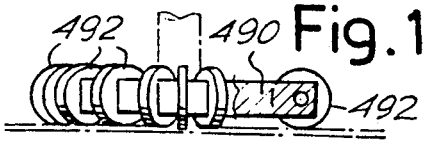

FIGS. 13, 14 show an improvement intended to prevent the sliding friction operated by the discs in the fabric advancement direction. A disc 490, similar to discs 476A, 476B, carries on its periphery wheels or rollers 492 idly rotating about substantially tangential axes. In this way, the sliding friction in the fabric feed direction is avoided, while, in the transverse direction, the discs 490 carry out the corrections on the chain.

In any case, the combination of the computerized opto-electronic reader and the actuators indicated by 468; 468A, 468B; 476A, 476B with relevant servomotors, allows an effective correction of the trend of the fabric chain pattern which develops in the direction of arrow fK.

An apparatus for the control and straightening of the chain, that is to say the warp, as above described, may be combined to an apparatus for the correction of the weft pattern, for the straightening of the fabric pattern lines having transversal development.

Figure 15:
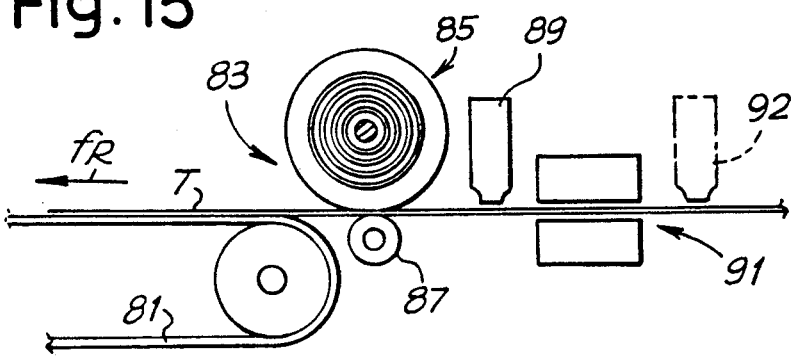
FIG. 15 schematically shows an application of the apparatus to a stenter dryer plant in combination with a chain straightener.

An application of the weft and/or warp straightener device is shown in FIG. 15, where the latter is combined to the so-called stenter dryer plant for the stabilization of the fabric during the fabric finish cycle. These stenter dryer plants include a conveyer like the one indicated by 81, which provides, in a known way, means for engaging the longitudinal edges of fabric T on the same conveyer, in order to stabilize the width. In these conditions the fabric is treated with various techniques, in particular, steam hot-treated and then dried during its transit in the direction of arrow fR inside the stenter dryer plant. The fabric which must be engaged to the conveyer 81 should have a correct weft pattern trend (and possibly a correct warp pattern trend as well). To this end there is provided a weft-straightening apparatus, generically indicated by 83, located upstream of the conveyer 81. This apparatus may be, for example, of the type having discoid members, as shown in FIGS. 1 and 2, to ensure a strong action on the fabric. In particular, numeral 85 indicates the set of the discoid actuators corresponding to the rotating members 9, 10, 11, 12 . . . N−2, N−1, N of FIGS. 1 and 2, and numeral 87 indicates a set of counteracting rollers similar to that indicated by 5 in FIGS. 1 and 2. Numeral 89 indicates an opto-electronic weft-pattern reader which controls the actuators 85. The plant may also be provided with a chain straightener 91, which may be controlled by an independent pattern reader like the one indicated by 92, or it may be controlled by the same reader 89 provided for the reading of the weft pattern. The weft and chain straighteners arrangement ensures the correct disposition of the fabric when it is engaged with its edges onto the conveyer 81 for the stabilization inside the stenter dryer.

FIGS. 16 to 19 show a doubling machine in various steps of the operating cycle and to which a pair of weft straighteners, substantially made as shown in FIGS. 3 and 4, is combined. The traditional doubling machine is an apparatus that should ensure the arrangement of two lengths of fabric one against the other with the right sides (or the back sides) facing one another, and with the weft, as well as the warp pattern (i.e. chain patterns) matching exactly. This is a strict requirement in the clothing industry for the manufacturing of clothes in which the patterns must be exactly symmetrical in the two symmetrical sides of the same garment. Until now, these doubling machines have only had the function to ensure the coincidence of the patterns in the initial zone of the two fabrics to be doubled, while it has been possible to ensure only by hand a settlment of one fabric onto the other in longitudinal direction, as far as the coincidence of the weft patterns is concerned, and in transverse direction, as far as the coincidence of the warp (or chain) patterns is concerned. The combination of a doubling machine with two weft straighteners and possibly with two chain straighteners ensures an automatic settlement of the two fabrics superimposed by the doubling machines, to achieve the coincidence of the patterns.

In the very schematic illustration of FIGS. 16 to 19, 101 indicates a tentering plane on which one of the two fabric sheets must be laid. To this plane 101 sliding means are associated for a carriage generically and roughly indicated by 103, which must be able to slide in the direction of arrow fC and in the opposite direction as well along said plane. On the carriage 103 is mounted a carrier able to be timely moved through 180° about a vertical axis. This carrier supports a roll 105 of fabric, from which the sheets must be successively unwound and detached for their dispositioning in matching and facing relationship. The fabric T coming from the roll 105 is suitably driven, in a manner known per se, by guiding and stretching means and by length-controlling means as well, all of known type, only the rollers 107 for guiding of the fabric T being shown. Numeral 109 generally indicates a weft straightener comprising belt-actuators 110 moved around pulleys 112, one of which is driving, in order to carry out a correction. Said weft straightener is combined with an opto-electronic reader 114 located inside the belts 110 which are suitably transparent to allow the reading of the second fabric sheet, in a manner to be indicated hereinafter, through the portion between the lower pulleys 112A and 112B of the set of transmission pulleys. One roll or one row of counteracting and feeding rollers 116 may be made to cooperate with the pulley 112B.

Numeral 118 generally indicates a first chain straightener intended to correct the chain pattern of the second sheet, whose weft pattern is corrected by the weft straightener 109 in a manner indicated below. The reader of the chain straightener 118 may be the same reader 114 or a suitable different reader combined with and in the vicinity of the chain straightener 118. Numeral 120 indicates a cutter that may act on the fabric T in the portion thereof comprised between the supply roll 105 and the rollers 107.

Numeral 122 indicates a further weft straightener located below the level of the tentering plane 101. Also this weft straightener is realized with actuators consisting of side-by-side belts 124 driven by transmission pulleys 126 two of which, namely pulleys 126A and 126B, define a portion of the belts through which a reader 128 is able to read due to the transparency of said belts. Numeral 130 indicates a chain straightener—operating with a suitable reader—which is also disposed below the level of the tentering plane 101 and sideway of the weft straightener 122. The straighteners 122 and 130 operate on the first sheet.

Numeral 132 indicates a conveyer intended to move away the two sheets which are matched in such a way as to have coincident weft and warp patterns. The conveyer 132 is provided with suction means for the retention of the two sheets.

Figure 18:
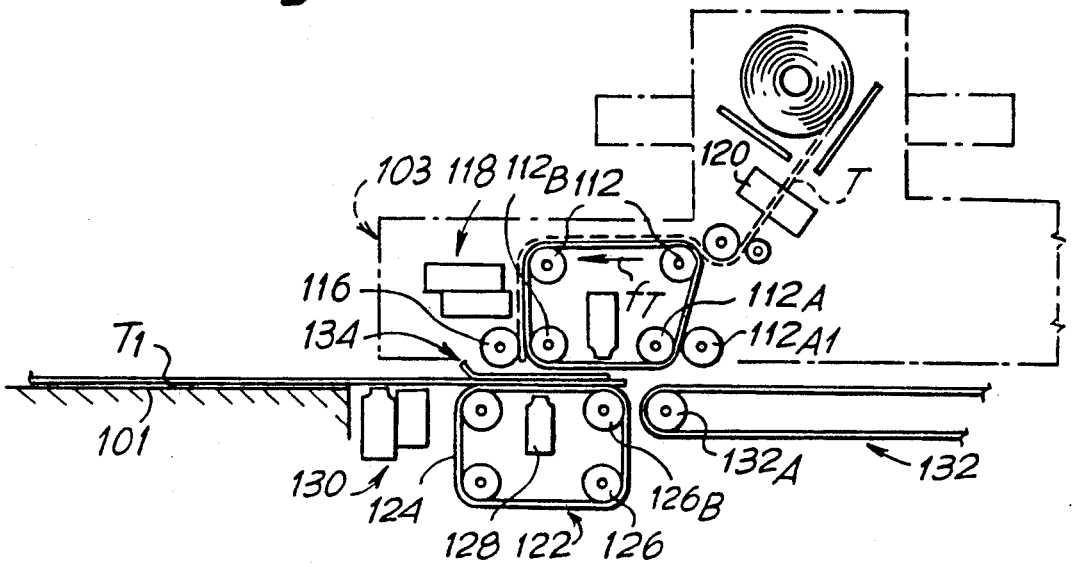
Figure 19:
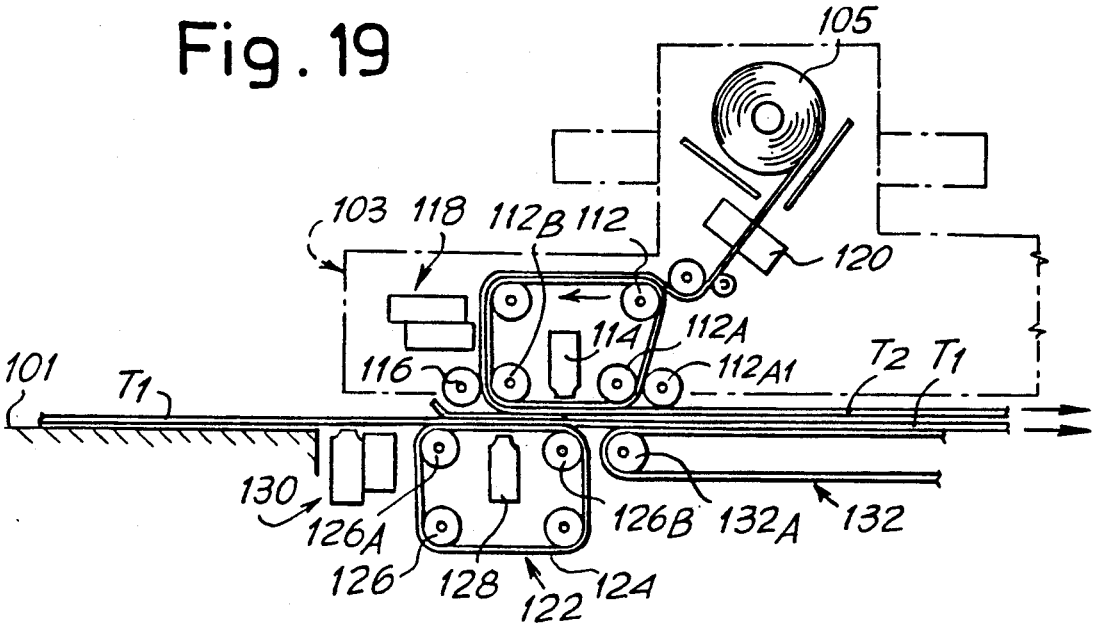

Numeral 134 indicates a shaped lamina which allows, in a manner indicated below, the sliding of the two sheets which are about to be superimposed and which must be corrected in their relative position according to the signals generated in accordance to the detections of the readers 114, 128. The lamina 134 is capable of being kept lifted up in the condition shown in FIG. 16, and being lowered afterwards as can be seen in FIGS. 17 to 19. The lowering takes place in correspondence of the weft straightener 122, i.e. just above the tentering plane 101, the latter extending past the active zone of the weft straightener 122 with the conveyer 132. The lamina 134 is intended to provide a counteracting surface for the weft straighteners 109 and 122.

Figure 16:
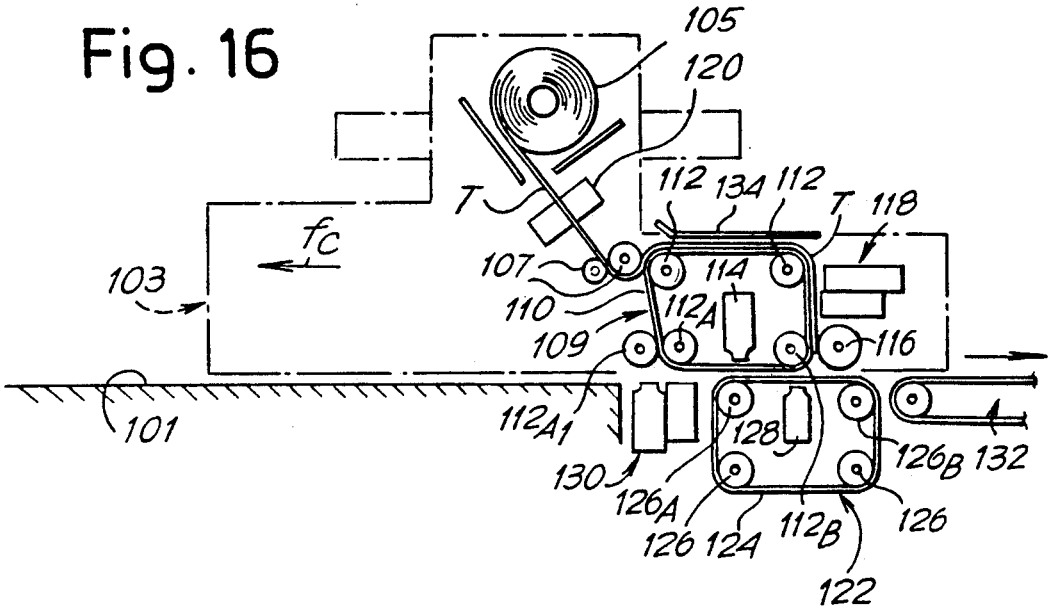
FIGS. 16, 17, 18 and 19 show an application to a so-called doubling machine, in various operating steps.
Figure 17:
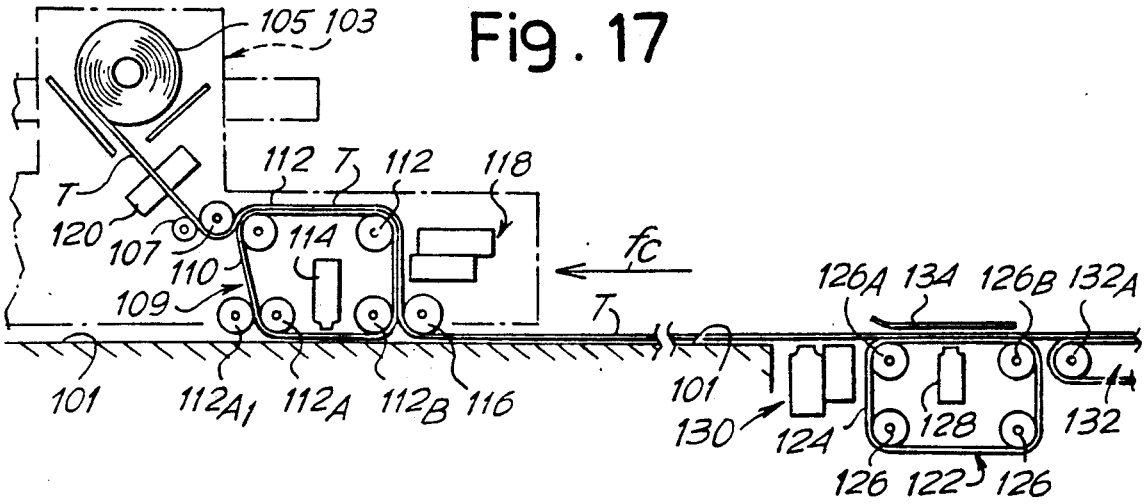

In the initial condition shown in FIG. 16, the carriage starts its movement in the direction of arrow fC and the fabric is made to unwind from the roll 105 along the trajectory shown in the drawing between the pulley 112B and the counteracting roller 116, so that the fabric, by unwinding during the displacement of the carriage in the direction fC, spreads the first sheet T1 as shown in FIG. 17, on the plane 101. As soon as the carriage 103 has passed the first part of its travel along the plane 101, stretching the fabric to form the first sheet T1 laid on the tentering plane 101, the lamina 134 is lowered down almost as far as the level of said plane 101, and thus above the initial part of sheet T1. When the carriage 103 has performed a travel in direction fC sufficient to spread the length corresponding to the first sheet T1, the cutting device 120 cuts the fabric and detaches the sheet T1, which is stretched completely by the further final portion of the carriage travel in the direction of arrow fC. Thereafter, the carriage is moved back in a direction opposite to arrow fC, while the carrier thereof, which supports the roll 105 and all the above described members, is rotated about a vertical axis in relation to the carriage, so that when the carriage reaches the position shown in FIG. 18, the various members of the carriage are overturned with respect to the condition shown in FIG. 16. The fabric is further fed in the direction of arrows fT in FIG. 18, being also transferred by the belts 110 above the lamina 134 until the initial edge of the fabric (defined by the cut previously performed) is brought into coincidence with the initial edge of sheet T1 already laid down.

The exact positioning of the weft pattern of the fabric now unrolling in the direction fT on FIG. 18 to bring it to coincide with the weft pattern of the initial zone of sheet T1, is achieved by the cooperation of the reader 114 under which the fabric unwinds in the direction of arrow fT. At this point, the edge of sheet T1 and the initial edge of the fabric previously cut by the device 120, coincide with one another, in particular with their weft patterns. At this point the advancement motion begins both for sheet T1 and fabric T in the direction of arrow fT, said fabric T being overturned with respect to said sheet T1. The advancement is obtained by the action of the belts 124 of the weft corrector 122, and the belts 110 of the weft corrector 109 until the pair of fabrics is handed over to the suction conveyer 132 with which a pulley 112A1 cooperates in side-by-side relationship with pulley 112A (or coincident therewith), to cooperate with the transmission roller 132A of conveyer 132. The first sheet T1, already laid down onto the plane 101, and the second sheet T2 which unwinds in the direction fT from roll 105 in the condition of FIG. 18 and gradually shifts into the condition of FIG. 19 and into the further conditions, are made to advance on the conveyer 132 as shown in FIG. 19. The two sheets T1 and T2 move in front to the respective weft straighteners 122, 109 and chain straighteners 130 and 118. In particular, the sheet T1 is controlled by the weft straightener 122 and by its reader 128, as well as by the chain straightener 130 and by the reader thereof (that may be the same reader 128 or a different one). The weft pattern of the sheet T2, which is being unwound in the direction fT along the belts 110 of the weft straightener 109, is controlled by said weft straightener 109 in cooperation with the reader 114, while the warp pattern is controlled and corrected by the chain straightener 118 which cooperates with a different reader or with the same reader 114. The weft straighteners 109 and 122 cooperates with the counteracting and opposite surfaces of the lamina 134. In any case, the two sheets T1 and T2 move forward on the conveyer 132 in a disposition which is correct as far as both the superimposition of the weft pattern and the superimposition of the chain pattern are concerned, inasmuch as these patterns are controlled and straightened by the respective straighteners, while the two readers 114 and 118 are associated through a control unit and a program to ensure the coincidence of the patterns read by each of the readers on the sheets T1 and T2, in order for these weft patterns to come to coincide with one another. The same thing holds true as far as the control and the cooperation between the readings and corrections of the chain straighteners 130 and 118 are concerned.

Accordingly, an automated, perfectly regular and coincident disposition of the patterns of the fabrics of the two sheets is achieved without the intervention of the operator.

Figure 20:
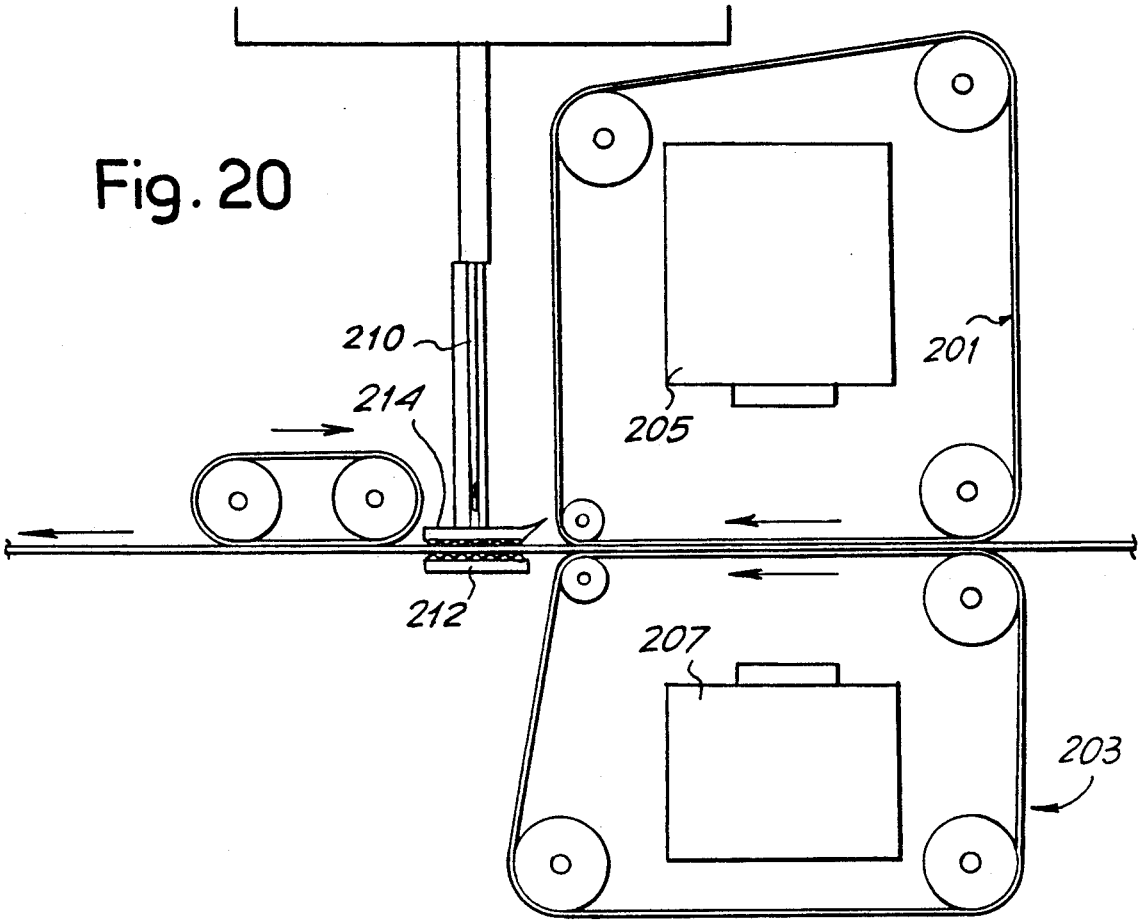
FIG. 20 shows a possible application of the apparatus to an edge-sewing machine.

FIG. 20 shows an outline of a sewing machine to which two weft straighteners 201 and 203, respectively, of the type illustrated in FIGS. 3 and 4 are combined, to control, by means of readers 205 and 207, the weft patterns of the edges of two fabrics to be sewn by the illustrated sewer. In the drawing, the sewer is shown with its needle 210 and the two lower and upper fabric conveyers 212 and 214, respectively. The two weft straighteners, with the two computerized opto-electronic readers, operate with the interposition of a lamina, in a way similar to that of the doubling machine, in order to adjust the advancement of the two straighteners and thus to make the weft patterns read by the two readers to coincide.

Figure 21:
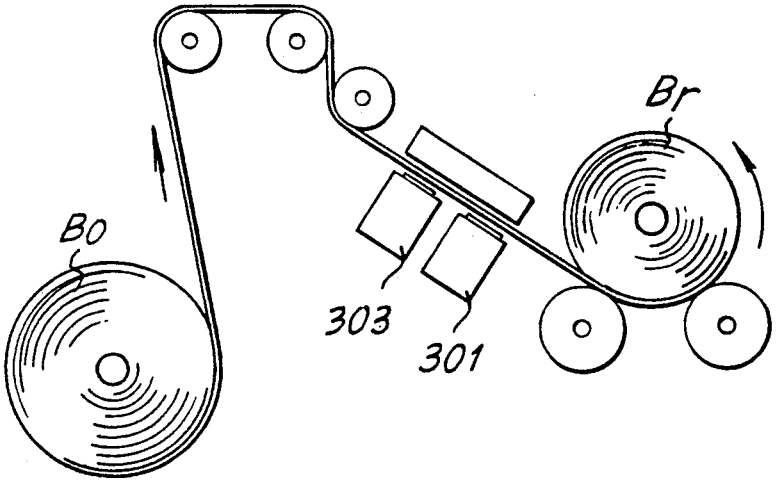
FIG. 21 shows a possible application of the apparatus to a rewinder group.

The apparatuses for the straightening of the weft and/or chain pattern may also be applied to other machines which must be equipped with systems for the adjustment of the weft pattern. For example, in the scheme of FIG. 21, a weft straightener 301 and a chain straightener 303, with relevant readers, are combined to a fabric rewinder. The fabric of coil BO or other supply, is made to transit in front of the two straighteners 301 and 303, and immediately rewound on the coil BR. The straighteners may also be used for adjusting the rewinding speed and thus the tension or looseness of the rewound fabric.

I claim:

1. Apparatus for the control and straightening of a woven fabrics pattern, comprising in combination: at least one computerized opto-electronic reader means for controlling the woven pattern of the fabric in front of a linear transverse inspection zone, said reader being able to detect the woven pattern deviation from a reference pattern; and a set of actuators with relevant servomotors controlled by signals emitted by said at least one opto-electronic reader means; each of said actuators being disposed to act on a corresponding fabric zone to locally correct the deviation of the pattern detected by the opto-electronic reader.

2. Apparatus according to claim 1, each of the actuators comprises a rotating member driven into rotation by the servomotor to act on the fabric.

3. Apparatus according to claim 1, wherein the actuators are disposed into alignment on at least one transverse front with respect to the longitudinal development of the fabric, each one of said actuators acting on a longitudinal zone of the fabric in transit.

4. Apparatus according to claim 1, wherein said actuators comprise rotating members driven into rotation by relevant servomotors, said members being distributed on two or more transmission axes.

5. Apparatus according to claim 1, wherein the reader is so disposed as to control a linear transverse inspection zone of the fabric close to the transverse zone of the fabric on which the actuators act.

6. Apparatus according to claim 1 wherein the actuators are continuous flexible belt-shaped member each being transparent, and said at least one reader means is disposed internally thereof in correspondence of the zone of said flexible members which act on the fabric.

7. Apparatus according to claim 1, wherein, in a chain or warp straightening apparatus, a rotating discoid member has, at the periphery, a pluarity of small cylinders or wheels which contact the fabric, said small cylinders being mounted on axes having tangential development with respect to said periphery, in order to reduce the friction on the fabric.

8. Apparatus according to claim 1 for chain straightening, wherein the actuators are disposed into alignment on a transverse front with respect to the longitudinal development of the fabric, each of said actuators including a driving shaft disposed parallel to the chain pattern.

9. Apparatus according to claim 1, wherein the actuators are disposed on at least two adjacent transverse alignments, those of one alignment being offset with respect to those of the other.

10. Apparatus according to claim 9, wherein each of said actuators include a driving shaft, the driving shaft of one actuator acting as a support for an idle transmission pulley of an adjacent actuator.

11. Apparatus according to claim 1, wherein at least one reader is disposed for controlling a linear transverse inspection zone of the fabric adjacent to the transverse zone of the fabric on which the actuators are made to act.

12. Apparatus according to claim 1, which is associated to a stenter dryer plant in order to acto on the incoming fabric to be engaged along its edges to a conveyor of said plant.

13. Apparatus according to claim 1, which is associated to a doubling and fabric tentering machine, for coupling two fabrics to each other, two apparatuses being provided for acting on each of the two fabrics, one independently of the other.

14. Apparatus according to claim 13, wherein the two readers of the two apparatuses are combined with a control unit to achieve a mutual correction of position and a coincidence of the weft and warp patterns of two doubled fabrics, during the doubling.

15. Apparatus according to claim 13 or 14, comprising a lamina, which is interposed between the two fabrics and which forms a counteracting surface for the actuators, which act on the respective fabrics from opposite sides of said lamina.

16. Apparatus according to claim 13, wherein the doubling and fabric tentering machine is supported by a carrier which can rotate of a angle of 180° about a vertical axis, said carrier also supporting driving and controlling means for the doubling and tentering machine.

17. Apparatus according to claim 1, in combination with a sewing machine for doubled fabrics for the sewing of their edges.

18. Apparatus according to claim 1, which is provided in combination with a fabric rewinder and comprising means for adjusting the advancement speed.

19. Apparatus for the control and straightening of fabrics pattern, comprising in combination: at least one computerized opto-electronic reader able to control the pattern of the fabric in front of a linear transverse inspection zone, said reader being able to detect the pattern deviation from a reference pattern; and a set of actuators with relevant servomotors controlled by signals emitted by said at least one opto-electronic reader; each of said actuators being disposed to act on a corresponding fabric zone to locally correct the deviation of the pattern detected by the opto-electronic reader, each of said actuators comprises a continuous flexible belt-shaped member, each driven by pulley means, at least of one said pulley means being driven into rotation by the servomotor to act on the fabric.

20. Apparatus for the control and straightening of fabrics pattern, comprising in combination: at least one computerized opto-electronic reader able to control the pattern of the fabric in front of a linear transverse inspection zone, said reader being able to detect the pattern deviation from a reference pattern; and a set of actuators with relevant servomotors controlled by signals emitted by said at least one opto-electronic reader; each of said actuators being disposed to act on a corresponding fabric zone to locally correct the deviation of the pattern detected by the opto-electronic reader, a plurality of rotating members being driven into rotation by relevant servomotors, and coaxially disposed, being actuated by coaxial shafts associated to the relevant servomotors.

* * * * *